United States Patent [19]

Scherrer

[11] Patent Number: 4,835,914

[45] Date of Patent: Jun. 6, 1989

[54] FALSE CEILING CONSTITUTED BY A STRETCHED SHEET FIXED ALONG ITS EDGES TO A SUPPORT FRAME

[76] Inventor: Fernand Scherrer, 2, rue Georges Bizet, 68170 Rixheim, France

[21] Appl. No.: 158,769

[22] Filed: Feb. 22, 1988

[30] Foreign Application Priority Data

Feb. 27, 1987 [FR] France ..... 87 02690

[51] Int. Cl.[4] ..... E04F 13/00

[52] U.S. Cl. ..... 52/28; 52/63; 52/222

[58] Field of Search ..... 52/222, 63, 83, 28, 52/22; 362/285, 288, 147, 148

[56] References Cited

U.S. PATENT DOCUMENTS

| | | | |
|---|---|---|---|
| 834,449 | 10/1906 | Carter | 362/285 |
| 2,067,252 | 1/1937 | Whelan | 52/222 |
| 3,388,515 | 6/1968 | Gruettner . | |
| 4,006,567 | 2/1977 | Flannery . | |
| 4,316,238 | 2/1982 | Booty et al. . | |

FOREIGN PATENT DOCUMENTS

| | | |
|---|---|---|
| 0137086 | 4/1985 | European Pat. Off. . |
| 3416161 | 11/1985 | Fed. Rep. of Germany . |
| 1515260 | 3/1968 | France . |
| 348536 | 10/1960 | Switzerland . |

*Primary Examiner*—James L. Ridgill, Jr.

*Attorney, Agent, or Firm*—McAulay Fisher Nissen & Goldberg

[57] ABSTRACT

A false ceiling comprises a stretched sheet made of a relatively elastic material which is hooked, along its edges, to a horizontal support frame constituted by abutting sections, fixed to the walls of a room. Above the sheet, i.e. in the space between this sheet and the ceiling of the room, means exert on the sheet at at least one point thereof, an adjustable effort provoking a deformation of the sheet. These means comprise a cable passing over a pulley fixed to the ceiling of the room, of which the vertical side acts, at its lower end, on the sheet, in order to exert thereon the adjustable vertical effort, and of which the other inclined or manoeuvring side is hooked on the wall, above the support frame, on this support frame itself or on the ceiling.

20 Claims, 1 Drawing Sheet

FALSE CEILING CONSTITUTED BY A STRETCHED SHEET FIXED ALONG ITS EDGES TO A SUPPORT FRAME

BACKGROUND OF THE INVENTION

The present invention relates to a false ceiling constituted by a stretched sheet which is fixed along its edges to a support frame itself fixed to the walls of the room in which the false ceiling is installed.

False ceilings of this type are already known, of which the stretched sheet which is constituted by a sheet of plastics material or of cloth, comprises, along each of its sides a border of plastics material whose cross-section is in the form of a hook or staple, this staple gripping on a shoulder of abutting sections constituting the support frame fixed to the walls.

Up to the present time false ceilings have been mounted with their stretched sheet horizontal in its entirety, or with inclined panels as describeb for example in French Patent FR A No. 1 515 260. In the case of such a false ceiling with inclined panels, one or more tension devices are disposed above the sheet and they are hooked to the ceiling. However, the sole purpose of these tension device is to ensure a satisfactory tension of the sheet, and they do not enable the overall appearance thereof to be easily modified in order to give a particularly appreciated overall aesthetic effect. Furthermore these tension devices are hooked to rigid strips and battens assembled together, between which the sheet is gripped, and consequently, the lower face of the sheet shows these strips, which is detrimental to the overall aesthetics of the false ceiling.

SUMMARY OF THE INVENTION

The present invention concerns improvements made to this type of false ceiling in order to obtain, by means which are very simple to carry out a deformation of the stretched sheet easily adaptable as a function of the desired aesthetic effect.

To that end, this false ceiling comprising a stret ched sheet made of a relatively elastic material which is hooked, along its edges, to a horizontal support frame constituted by abutting sections, fixed to the walls of a room and, above the sheet, i.e. in the space between this sheet and the ceiling of the room, means exerting on the sheet, at at least one point thereof, an adjustable effort provoking a deformation of the sheet, is characterized in that the means exerting an adjustable vertical effort, downward or upward, at at least one point of the sheet, comprise a cable passing over a pulley fixed to the ceiling of the room, of which the vertical side acts at its lower end, on the sheet in order to exert thereon the adjustable vertical effort and of which the other inclined or manoeuvring side is hooked on the wall, above the support frame, on this support frame itself or on the ceiling.

The lower end of the vertical side of the cable may be hooked to a heavy object, abutting on the stretched sheet and exerting thereon, by its own weight a downward pressure producing a downwardly projecting protuberance of the sheet. The heavy object may be of any appropriate shape depending on the shape it is desired to obtain for the protuberance. It may be constituted by a spherical or elliptic bloc or a prismatic block of various cross sections, or any shapes.

According to a variant embodiment of the invention, the lower end of the vertical side of the cable is hooked at one point of the sheet in order to be able to exert thereon a local upward traction. Such traction provokes the formation in the sheet of a hollow of substantially pyramidal or conical form. In particular, the vertical side of the cable may be hooked to a lighting device such as a spotlight or the like fixed to the sheet, thereabove, about an opening made therein for the passage of the light flow emitted by the lighting devicce. In that case, the lighting device occupies the top of the hollow part of appropriate, substantially pyramidal or conical shape or any other shape as a function of the desired deformation.

BRIEF DESCRIPTION OF THE DRAWINGS

The invention will be more readily understood on reading the following description with reference to the accompanying drawings, in which.

Figure 1:
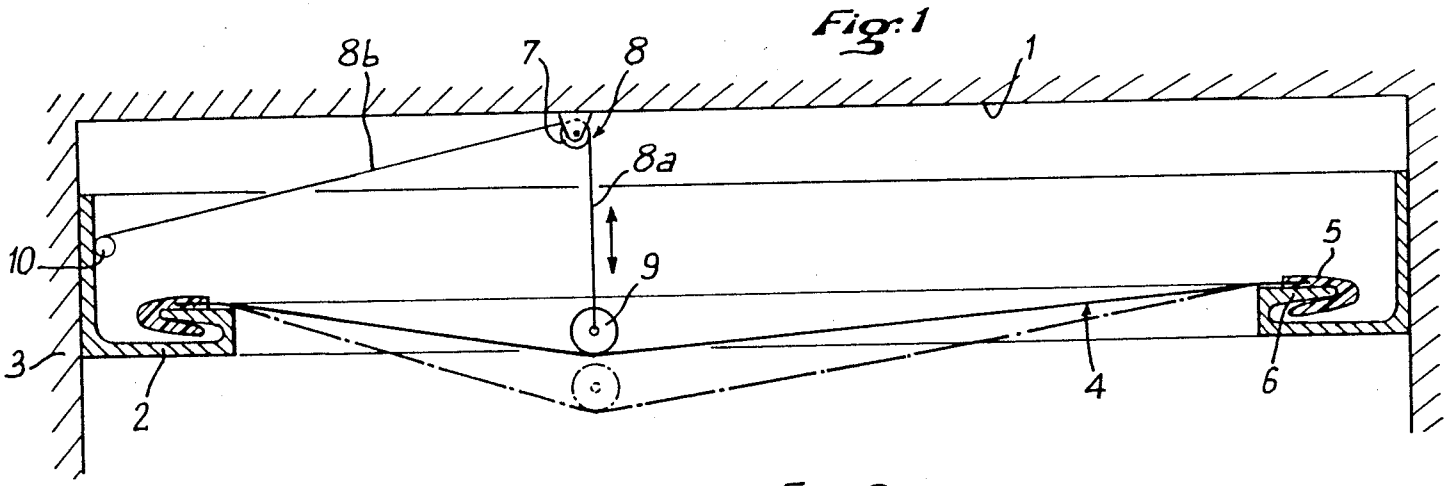
FIG. 1 is a schematic view in vertical section of a false ceiling according to the invention, employing a heavy object to downwardly deform the stretched sheet.

Referring now to the drawings, the false ceiling shown in FIG. 1 extends in the upper part of a room, below the ceiling 1 thereof, and it essentially comprises a horizontal support frame 2, fixed to the walls 3 of the room, constituted by abutting sections, and a sheet 4 stretched horizontally within the support frame 2. This sheet 4 comprises, on each of its sides, a border 5 in the form of a staple, which hooks on a shoulder 6 provided on the support frame 2. In the non-limiting embodiment shown in the drawing, each section of the support frame 2 is constituted by an angle and the shoulder 6 is formed at the end of the lower horizontal flange of the angle.

The horizontal support frame is composed of two legs, one of which is fixed to wall 3 and extends towards the ceiling 1 above the sheet 4, and the other leg extends in a substantially orthogonal portion to said one leg and in a direction substantially parallel to ceiling 1.

Frame 2 can be attached to wall 3 by any conventional means such as gluing or by means of bolts (not shown).

The stretched sheet 4 is constituted by a relatively elastic material; for example, it may be constituted by a sheet of polyvinyl chloride.

According to the invention, means are provided for deforming the sheet 4 so as to move it from its strictly horizontal position.

In the embodiment of the invention shown in FIG. 1 these means comprise, for each point where the sheet 4 is to be deformed, a pulley 7 or like member fixed beneath the ceiling 1, vertically above the point having to be deformed. Over this pulley 7 passes a cable 8 of which the vertical side **8*a* is hooked, at its lower end, to a heavy object 9, which is for example spherical in form. The cable 8 comprises another inclined side 8*b* which goes from the pulley 7 and extends up to a point 10 for fixation to the wall 3, above the support frame 2, or to this support frame itself or to the ceiling 1**.

Consequently, it is very simple for the installer of the false ceiling to adjust the position of the heavy object 9 as desired as a function of the effect of deformation of the sheet 4 which it is desired to obtain. Before definitively hooking the sheet 4, he adjust the vertical position of the heavy object 9 approximately, pulling more or less on the side 8*b* of the cable 8, after which he attaches this cable to the wall at the point of fixation 10. He then assembles the sheet completely, i.e. by engaging its staple-shaped border 5 on the shoulder 6. Due to the pressure exerted by the heavy object 9, the stretched sheet 4 deforms by extending, and it is pushed downwardly beneath the heavy object 9. It thus takes a substantially pyramidal or conical shape as shown in FIG. 1. If this shape is not judged satisfactory, it is then very easy to unhook the sheet 5, over a short length, to modify the vertical position of the heavy object 9 by acting on the manoeuvring side 8*b* of the cable 8, in order to accentuate or, on the contrary, to reduce the deformation of the stretched sheet 4, and to rehook this sheet. In FIG. 1, the chain-doted lines indicate a lower position of the heavy object 9, position which accentuates the deformation of the sheet.

The shape taken by the sheet 4, when it is thus deformed under the action of the heavy object 9, depends on the shape of this heavy object. To that end, either a spherical object may be used, as shown in the drawing, or a block having any other form, particularly prismatic star shaped, etc . . . in order to bring about a particularly aesthetic deformation of the sheet from the point where it is in contact with the heavy object 9.

Figure 2:
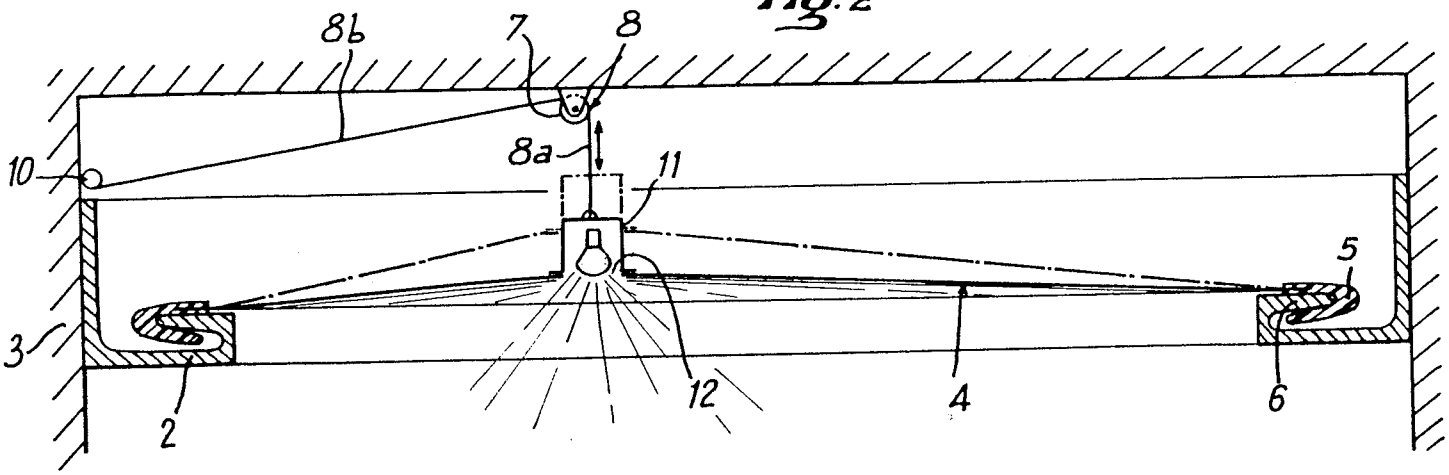
FIG. 2 is a schematic view in vertical section of a variant embodiment of the false ceiling in which the sheet is pulled locally upwardly.

In the variant embodiment shown in FIG. 2, the vertical side 8*a* of the cable 8 is hooked to any lighting device 11, such as a spotlight, which is itself fixed to the sheet 4, thereabove, around an opening 12 for the passage of the light flow from the lamp of the spotlight 11. In that case, as the vertical side 8*a* of the cable 8 is hooked to the spotlight 11, it is possible, by exerting a traction on the manoeuvring side 8*b*, to raise the spotlight 11 more or less and to create in the sheet 4 a more or less accentuated hollow depending on the desired aesthetic effect. There again, the position of the spotlight 11 is very easily adjusted since it suffices to pull more or less on the manoeuvring side 8*b* of the cable 8.

The lighting device 11 may be of any other shape and it may, in particular, be constituted by a box element.

According to a variant embodiment the vertical side 8*a* of the cable 8 may be hooked to an anchoring member fixed at any point of the upper face of the sheet 4, without being visible below the sheet. This anchoring member may be constituted by a tab glued or welded on the upper surface of the sheet.

From the foregoing description, it is seen that the invention makes it possible to obtain a deformation, adjustable as desired of a stretched sheet 4 in one piece to give it a desired aesthetic appearance, and this without showing any of the means used for adjusting the deformation of the sheet which are all housed between the sheet and the ceiling. Consequently, the stretched, deformed sheet presents a lower surface bereft of visible connecting members such as strips and battens.

What I claim is:

1. A false ceiling comprising:

a horizontal support frame;

a stretched sheet made of a relatively elastic material having means along spaced edges for hooking to said horizontal support frame, said horizontal frame including an abutting section for each of the spaced edges fixed to the walls of a room to define a space between the ceiling and the space above the sheet between the sheet and the ceiling and to have said sheet extend in a substantially horizontal direction relative to the walls;

said support frame including a first and a second leg, with said second leg being substantially horizontal and parallel to the ceiling and said first leg abutting said wall; and sheet provoking deformation means operatively associated with said ceiling and said wall and said sheet for exerting onto the sheet, at at least one point thereof, an adjustable effort for provoking a deformation of the sheet, said provoking deformation means including a first means exerting an adjustable vertical effort along a vertical axis downwardly or upwardly, at at least one point of the sheet, and second means and at least one of said wall, said ceiling and said support frame for exerting a manoeuvering effort onto said sheet through the intermediation of said first means.

2. The false ceiling as claimed in claim 1, wherein said second means is hooked onto said wall.

3. The false ceiling as claimed in claim 1, wherein said second means is hooked above said support frame.

4. The false ceiling as claimed in claim 1, wherein said second means is hooked onto the ceiling.

5. The false ceiling as claimed in claim 1, wherein said sheet provoking deformation means includes a pulley fixed to said ceiling and a cable passing over said pulley having a first side and a first end extending vertically from said pulley, said first end being connected with said first means and a second side extending from said pulley and a second end connected with said second means for connecting said first means and said second means together, said first means connecting said cable with said sheet along said vertical axis for exerting a vertical directional movement onto said sheet and controlling said adjustable vertical effort, and said second means exerting the manoeuvering effort directly onto said sheet through said cable, said pulley and said first means.

6. A false ceiling according to claim 5, said first means including a lighting device fixed to said sheet, and wherein the vertical side of the cable is hooked to said lighting device fixed to the sheet, thereabove, about an opening made therein for the passage of light flow emitted by the lighting device.

7. A false ceiling according to claim 5, wherein the lower end of the vertical side of the cable is hooked at one point of the sheet by said first means for exerting thereon a local upward traction.

8. A false ceiling according to claim 7, said first means including a lighting device fixed to said sheet and the vertical side of the cable being hooked to said lighting device through said first means and fixed to the sheet, thereabove, about an opening made therein for the passage of light flow emitted by the lighting device.

9. A false ceiling according to claim 1, said first means including a heavy object abutting onto said stretched sheet, and the lower end of which said vertical side of said cable is hooked to said heavy object for exerting onto said stretched sheet by its own weight, a downward pressure for producing a downwardly projecting protuberance of the sheet so that said protuberance extends below the horizontal position of said sheet.

10. A false ceiling according to claim 9, wherein said heavy object includes a spherical block, said block being adapted to have various cross sections.

11. A false ceiling according to claim 9, wherein the heavy object is constituted by an elliptic block of various cross sections.

12. A false ceiling according to claim 9, wherein the heavy object is constituted by a prismatic block of various cross sections.

13. A false ceiling for use with the upper part of a room having a conventional ceiling and side walls, comprising:

a horizontal support frame having first and second leg portions forming a substantially L-shaped member, said first leg portion being substantially parallel to and spaced from said ceiling, and said second leg portion being adapted to be fixed to a wall portion of said side walls, said first leg portion including at an end thereof an angle shoulder;

an elastic sheet having on each of its sides a border in the form of a staple for hooking onto said angle shoulder and holding said sheet in a substantially horizontal position; and means for deforming said sheet to move it from its substantially horizontal position comprising pulley and cable means for each point where said sheet is to be deformed by moving the sheet from its substantially horizontal position either in a direction towards the ceiling or away from the ceiling and out of said substantially horizontal position;

said pulley and cable means comprising a pulley fixed beneath the ceiling and above said sheet and, a cable passing over said pulley and having a first end hookedly coupled with at least one of the points of said sheet where said sheet is to be deformed and extending to said pulley and a second end fixed to and extending from at least one of said wall and said ceiling between the ceiling and said sheet and extending to said pulley.

14. The false ceiling as claimed in claim 13, wherein said first end extends substantially vertically from said pulley to said sheet.

15. The false ceiling as claimed in claim 13, wherein said second end is fixed to a side wall and extends at an angle from the vertical from said side wall to said pulley.

16. The false ceiling as claimed in claim 13, wherein said second end is operatively fixed to said ceiling.

17. The false ceiling as claimed in claim 13, including a lighting device fixed to said sheet at one of the points where said sheet is to be deformed, and means coupling said one end of said cable with said lighting device.

18. The false ceiling as claimed in claim 13, wherein said second end is a manoeuvering end to adjust the vertical height of the sheet position at the point where the sheet is to be deformed.

19. The false ceiling as claimed in claim 13, wherein said second end is fixed to said horizontal support frame and extends at an angle from the vertical from said support frame to said pulley.

20. The false ceiling as claimed in claim 19, including a lighting device fixed to said sheet at one of the points where said sheet is to be deformed, and means coupling said one end of said cable with said lighting device.

* * * * *